United States Patent [19]

Baret

[11] Patent Number: 4,747,351

[45] Date of Patent: May 31, 1988

[54] SOLID-STATE WHISTLE AND HORN ACTIVATION SYSTEM FOR MODEL RAILROADS

[76] Inventor: David B. Baret, 243 Wayne Dr., Mars, Pa. 16046

[21] Appl. No.: 810,237

[22] Filed: Dec. 18, 1985

[51] Int. Cl.[4] ..... B60L 1/00

[52] U.S. Cl. ..... 104/297; 340/384 E

[58] Field of Search ..... 104/296, 297, DIG. 1; 246/473 A, 61, 81; 340/384 E, 384 R; 307/2

[56] References Cited

U.S. PATENT DOCUMENTS

| | | | |
|---|---|---|---|
| 2,155,343 | 4/1939 | Bonanno | 246/81 X |
| 2,172,468 | 9/1939 | Giaimo | 104/297 X |
| 2,990,964 | 7/1961 | Timmer | 104/297 X |
| 3,341,842 | 9/1967 | Breguet | 104/297 X |
| 3,705,287 | 12/1972 | Stern et al. | 104/297 X |
| 3,893,107 | 7/1975 | Schedler | 340/384 E |

FOREIGN PATENT DOCUMENTS

| | | | |
|---|---|---|---|
| 2014770 | 8/1979 | United Kingdom | 104/297 |

*Primary Examiner*—Joseph A. Orsino
*Assistant Examiner*—Brian R. Tumm
*Attorney, Agent, or Firm*—Clifford A. Poff; Thomas H. Murray

[57] ABSTRACT

Apparatus for actuating a sounding device for model railroad engines powered by an alternating-current voltage impressed across two rails, which apparatus is completely solid state in nature. The system includes input and output transistors which are normally non-conducting together with means for producing a direct-current bias voltage for turning ON the input transistor when a direct-current bias voltage is superimposed on the alternating-current voltage impressed across the two rails. The input and output transistors are interconnected such that when the input transistor conducts so also does the output transistor to thereby power the sounding device.

6 Claims, 2 Drawing Sheets

SOLID-STATE WHISTLE AND HORN ACTIVATION SYSTEM FOR MODEL RAILROADS

BACKGROUND OF THE INVENTION

While not necessarily limited thereto, the present invention is particularly adapted for use as a rectrofit kit for older-type model trains. The whistle used on a model steam engine of this type was ordinarily actuated by a shaded pole relay which, in turn, energized an alternating-current whistle motor. In diesel engine models, a direct-current buzzer, powered by a battery, was also actuated by a shaded pole relay. The relay, in turn, was tripped by a direct-current voltage superimposed on the alternating-current voltage used to power the engine.

In prior art devices of this type, the shaded pole relay had a tendency to become magnetized over a period of time, holding the relay contacts closed. In the case of a battery-operated horn, this condition would, of course, drain the battery; and, in addition, the battery contacts would often become corroded or bent, making the device inoperable.

SUMMARY OF THE INVENTION

The present invention provides a means for actuating a whistle motor or horn for model train engines which is formed entirely from solid-state components and which eliminates the need for a relay and its attendant contact and sticking problems.

In one embodiment of the invention, intended for use with model diesel engine horns, two direct-current power supplies are utilized, one positive and one negative. The positive supply is used for a monitoring and switching circuit; while the negative supply is used for powering a replacement-type buzzer horn utilized on the engine.

In another embodiment of the invention, intended for use with model steam engines, one negative power supply is employed. This negative power supply is applied to a monitoring and switching circuit which, in turn, controls the application of an alternating-current voltage to a whistle motor.

BRIEF DESCRIPTION OF THE DRAWINGS

The above and other objects and features of the invention will become apparent from the following detailed description taken in connection with the accompanying drawings which form a part of this specification, and in which.

DESCRIPTION OF THE INVENTION

Figure 1:
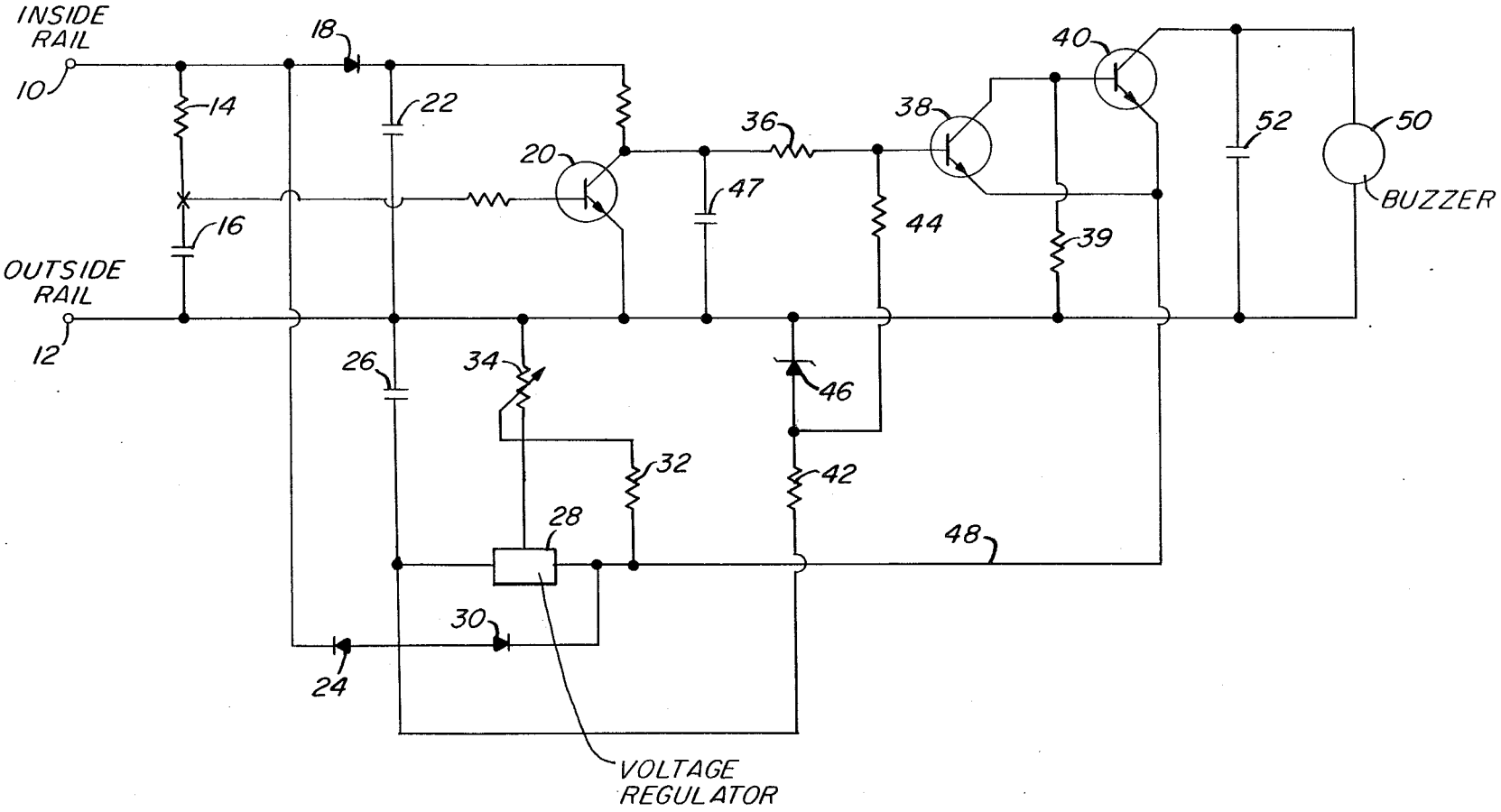
FIG. 1 is a schematic circuit diagram of a system for supplying direct current to a model diesel train horn.

With reference now to the drawings, and particularly to FIG. 1, the system is intended for use with a model railroad utilizing two outside rails and one inside rail. The inside rail is indicated schematically by the reference numeral 10; while one of the outside rails is indicated by the reference numeral 12. Applied across these rails is an alternating-current voltage derived from a model train transformer, not shown. As is conventional, the transformer is provided with a separate secondary winding connected to a rectifier. A direct-current voltage can be selectively added to the alternating-current voltage applied to the rails 10 and 12 by closing an appropriate pushbutton switch. It is this direct-current voltage which is utilized to actuate a whistle motor in the case of a model steam engine or a buzzer horn in the case of a model diesel engine.

In FIG. 1, the alternating-current voltage across the rails 10 and 12 is applied to a resistor 14 and capacitor 16 in series connected across the two rails. The rails 10 and 12 are connected to the secondary winding of a model train transformer as explained above. With this arrangement, the element 16 will simply shunt the alternating-current voltage. The alternating-current voltage will be developed across resistor 14 with point X being at common potential.

Rail 10 is connected through a diode rectifier 18 and the resistor shown to the collector of an NPN input transistor 20 which is normally non-conducting. The base of transistor 20 is connected through a resistor to the junction point X of resistor 14 and capacitor 16 as shown. Capacitor 22 acts as a filter capacitor for the rectifier 18.

The rail 10 is also connected to the cathode of a second diode 24 having its anode connected through a filter capacitor 26 to the outside rail 12. The resulting voltage across capacitor 26 is applied to a voltage regulator 28 which has a diode 30 in shunt with it for the purpose of shunting voltage spikes around the regulator 28. The output of the voltage regulator can be varied by means of a voltage divider comprising resistors 32 and 34, the resistor 34 being variable.

Referring again to the transistor 20, its collector is connected through resistor 36 to the base of a second NPN transistor 38 which is normally conducting and which shunts a bias voltage developed across resistor 39 to maintain a third NPN transistor 40 normally non-conducting. Note that the anode of diode 24 is connected through resistors 42 and 44 to the base of transistor 38 to maintain it normally conducting. Element 46 is a Zener diode connected to resistor 42 to provide a regulated 5 volt direct current. Capacitor 47 is connected as shown across the output of transistor 20.

The output of the voltage regulator 28 is connected through lead 48 as a negative voltage to the emitter of output transistor 40. Connected between the collector of transistor 40 and the outside rail 12 is a buzzer horn 50 for a model diesel engine. A capacitor 52 is connected in parallel with the buzzer horn 50 and acts as a filter capacitor to shunt noise produced in the supply line, thereby eliminating unnatural harmonics by the buzzer horn.

In the operation of the circuit of FIG. 1, and in the absence of the direct-current component applied to the rails 10 and 12, the normal alternating-current signal applied to those rails will be shunted by capacitor 16 and will be developed across resistor 14. However, when a signal comprising an alternating-current voltage and a 1–1.5 direct-current voltage is applied across the rails, a direct-current voltage is developed across capacitor 16 resulting in a positive signal produced on the base of transistor 20 which turns ON and, in turn, turns OFF transistor 38. As a result, transistor 40 now conducts to apply the direct-current voltage on lead 48 across the buzzer horn 50 to cause the horn to sound.

In this manner, it will be appreciated that a shaded pole relay is not required as in prior art horns for model diesel engines. At the same time, a battery is no longer required in the engine since the direct-current voltage for energizing the buzzer horn is supplied from the voltage regulator 28 which can be varied from 1 volt to 2 volts direct current.

Figure 2:
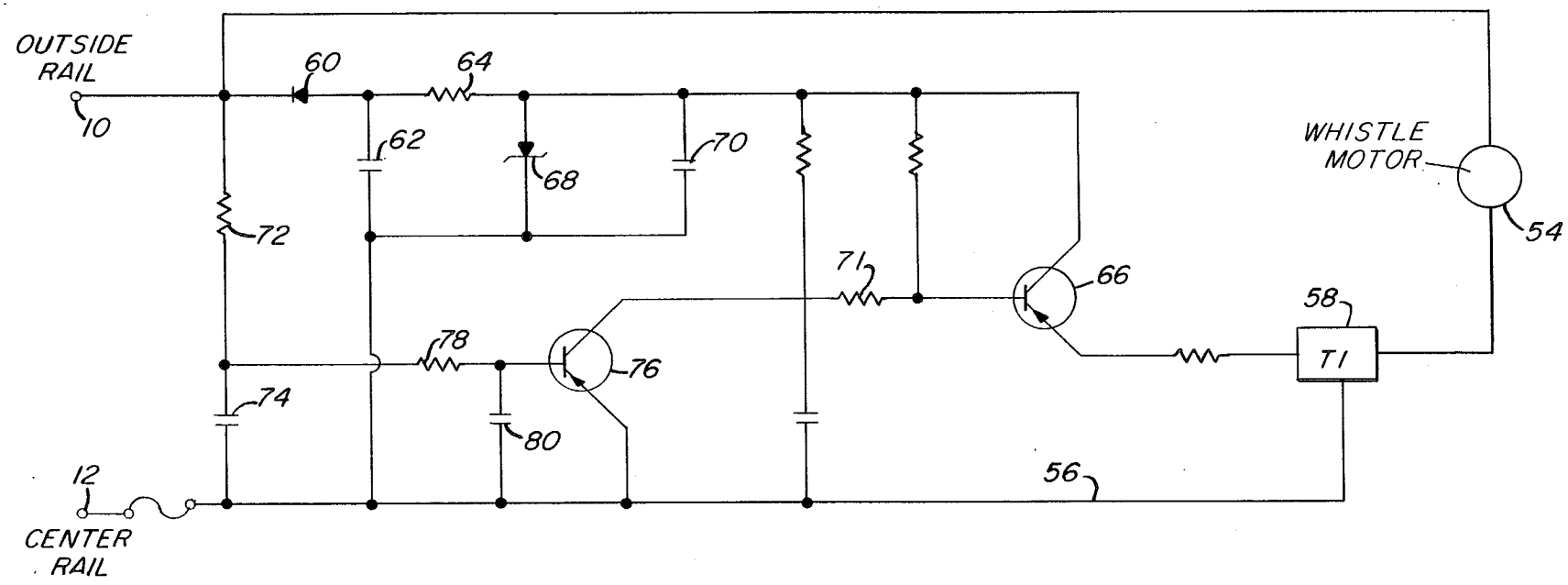
FIG. 2 is a schematic diagram of another embodiment of the invention adapted to supply alternating-current voltage to a whistle motor for a model steam engine.

In FIG. 2, an embodiment of the invention is shown for energizing an alternating-current whistle motor 54 for a model steam engine. In this case, the center rail 12, which is common, is connected through lead 56 to a TRIAC 58 which is normally non-conducting. Until the TRIAC 58 conducts, the alternating-current whistle motor 54 is not actuated. The outside rail 10 is connected as shown to a rectifying diode 60 and filter capacitor 62 to common, the anode of the diode being connected through resistor 64 to the collector of NPN output transistor 66. Zener diode 68 and capacitor 70 are in parallel with the filter capacitor 62 and form a regulated direct-current 5-voltage supply. The collector of input transistor 76 is connected to the base of transistor 66 through resistor 71 as shown.

As in the embodiment of FIG. 1, the alternating-current voltage across the rails 10 and 12 is applied across resistor 72 and capacitor 74 in series; and this combination ordinarily shunts the alternating-current voltage. However, when a superimposed signal is applied across the rails 10 and 12, a negative bias is applied to the base of PNP transistor 76 which is normally non-conducting but which is turned ON by the negative bias supply to the base of transistor 76 via resistor 78. This negative bias, when it turns ON transistor 76, also turns ON transistor 66 to turn ON the TRIAC 58, thereby applying voltage across the whistle motor 54.

Although the invention has been shown in connection with certain specific embodiments, it will be readily apparent to those skilled in the art that various changes in form and arrangement of parts may be made to suit requirements without departing from the spirit and scope of the invention.

I claim as my invention:

1. Apparatus for actuating a sounding device for a model railroad engine powered by an AC voltage impressed across two rails comprising a solid state circuit having:

means for receiving a first signal indicative of said AC voltage impressed across said two rails, said AC voltage being present to power said engine and said sounding device;

means for generating a second signal indicative of a DC biased voltage superimposed on the two rails comprising a shunt circuit coupled to the two rails which shunts the AC voltage impressed across the two rails; and means supplied by said AC voltage for powering said sounding device responsive to times when said second signal is generated.

2. The apparatus of claim 1 wherein the means for receiving include a rectifier.

3. The apparatus of claim 2 wherein said sounding device is electrically coupled to said means for powering which includes transistor means whereby said transistor means allows said second signal to be provided to the sounding device to actuate the device thereby during times in which the DC biased voltage is superimposed on the two rails.

4. The apparatus of claim 1 wherein said sounding devide includes an alternating current whistle motor and said means for powering includes a Triac connected between one of said rails and said whistle motor.

5. The apparatus of claim 4 wherein said second signal is supplied to said Triac for turning on said Triac during times in which the DC biased voltage is superimposed on the two rails.

6. The apparatus of claim 5 wherein said first signal indicative of the AC voltage impressed across the two rails is applied through said Triac to the alternating current whistle motor during times in which the Triac is turned on.

* * * * *